US009549600B2

(12) United States Patent
Juillet et al.

(10) Patent No.: US 9,549,600 B2
(45) Date of Patent: Jan. 24, 2017

(54) FOLDING BOX FOR A TIMEPIECE

(71) Applicant: Tissot S.A., Le Locle (CH)

(72) Inventors: Charline Juillet, La Chaux-de-Fonds (CH); Benjamin Bouhan, Metabief (FR)

(73) Assignee: Tissot S.A., Le Locle (CH)

( * ) Notice: Subject to any disclaimer, the term of this patent is extended or adjusted under 35 U.S.C. 154(b) by 102 days.

(21) Appl. No.: 14/696,781

(22) Filed: Apr. 27, 2015

(65) Prior Publication Data

US 2015/0335117 A1 Nov. 26, 2015

(30) Foreign Application Priority Data

May 23, 2014 (EP) ..... 14169701

(51) Int. Cl.

| | |
|---|---|
| ***A45C 11/04*** | (2006.01) |
| ***A45C 11/16*** | (2006.01) |
| ***A45C 11/10*** | (2006.01) |
| ***B65D 5/42*** | (2006.01) |
| ***B65D 5/02*** | (2006.01) |
| ***B65D 5/32*** | (2006.01) |
| ***B65D 5/50*** | (2006.01) |
| ***B65D 85/40*** | (2006.01) |

(52) U.S. Cl.

CPC ..... *A45C 11/16* (2013.01); *A45C 11/10* (2013.01); *B65D 5/02* (2013.01); *B65D 5/326* (2013.01); *B65D 5/42* (2013.01); *B65D 5/50* (2013.01); *B65D 85/40* (2013.01); *B65D 2313/04* (2013.01)

(58) Field of Classification Search

CPC ..... A45C 11/10; A45C 11/16; B65D 5/02; B65D 5/32; B65D 5/42; B65D 5/50; B65D 85/40

USPC ..... 206/6.1, 18, 70, 301; 229/116.1

See application file for complete search history.

(56) References Cited

U.S. PATENT DOCUMENTS 1,486,629 A * 3/1924 Buchsbaum ..... A45C 11/16 206/37

2,556,638 A 6/1951 Wickersham (Continued)

FOREIGN PATENT DOCUMENTS

EP 2 602 205 A1 6/2013

OTHER PUBLICATIONS

European Search Report issued Oct. 28, 2014 in European Application 14169701.1, filed on May 23, 2014 (with English translation).

*Primary Examiner* — Luan K Bui

(74) *Attorney, Agent, or Firm* — Oblon, McClelland, Maier & Neustadt, L.L.P.

(57) ABSTRACT

Folding, flat storable box including a foldable inner container, formed by a first longitudinal band closed on itself and forming a first deformable prism unfoldable between a flat position and a deployed position, and secured to a second transverse band secured, on a base, to a third longitudinal band deformable between a flat position and a folded position where the third band closed on itself surrounds the inner container which can be folded over, when the inner container is in a deployed and folded down position, in abutment on the main base, where the base includes at least one projecting indexing element for holding the inner container in a single particular deployed position of the first prism on the base, when the inner container is in the position folded over onto the base.

13 Claims, 7 Drawing Sheets

(56) References Cited

U.S. PATENT DOCUMENTS

| | | | | | |
|---|---|---|---|---|---|
| 3,690,542 | A * | 9/1972 | Jernstrom | B65D 5/4229 | 206/457 |
| 4,767,000 | A * | 8/1988 | Ovadia | A45C 9/00 | 206/495 |
| 5,325,960 | A * | 7/1994 | Sims | B65D 5/4204 | 206/301 |
| 6,059,098 | A * | 5/2000 | Ovadia | A47F 7/02 | 206/480 |
| 6,085,898 | A * | 7/2000 | Ovadia | A45C 11/16 | 206/480 |
| 2014/0318992 | A1 * | 10/2014 | Morelli Carullo | B65D 5/327 | 206/6.1 |

* cited by examiner 100
80
90
26
43
22
25
23
8
27
28
40
39
38
37
36
35
72
34
30S
29
30
31
41
42
32
33
71
20
10
21
24
11
12
13
14
15
220
16
17
18
19

T
L
100
10
11
12
13
14
15
17
19
20
20A
21
220
24
25
26
27
28
29
30
32
33
34
35
36
37
38
39
43
71
72
80
10A

FOLDING BOX FOR A TIMEPIECE

This application claims priority from European patent application No. 14169701.1 filed May 23, 2014, the entire disclosure of which is hereby incorporated herein by reference.

FIELD OF THE INVENTION

The invention concerns a folding box or case for the packaging of at least one object or a piece of jewellery or timepiece, said folding box being flat-storable in a base plane defined by a longitudinal direction and by a transverse direction, said box including a foldable inner container formed by a first band closed on itself deployed position where said first deformable prism is open at two opposite ends in a direction parallel to said transverse direction, said inner container including a handling surface which is secured to a second band extending in said transverse direction, and said second band being secured, on a base separate from said inner container, to an outer envelope formed by a third band extending in said longitudinal direction and deformable between a flat storage position in said plane and a folded position where said third band is closed on itself and arranged to surround said inner container, said inner container is foldable along a fold comprised in said second band between said handling surface and said base, when said inner container is in a deployed position and is in a folded over position, supported on an upper surface of said base so that one of said outer openings of said inner container is closed by said base.

The invention concerns the field of packaging objects, and more specifically the field of boxes, or packages for the transport or storage of timepieces or pieces of jewellery.

BACKGROUND OF THE INVENTION

Packaging objects, particularly pieces of jewellery or timepieces requires the provision of proper protection of the object.

Padding is normally used for this purpose, but the padding is generally not multi-purpose, or it does not protect the object properly, It is preferable to move the object away from the walls of the case or box, to protect it from any shocks or stresses to which the box is subjected.

In the particular case of pieces of jewellery or timepieces of substantially toroid shape, it is known to use cushions on which the objects are placed, however the cushion itself has to be held in place, by being fitted inside a cavity, or by placing padding on either side of the cushion.

Good packaging is relatively complex, includes several components, and may be expensive with respect to the cost of the object to be protected.

Creating packaging with a moderate production cost devised to offer optimum protection of the timepiece or piece of jewellery is thus a permanent preoccupation of timepiece/jewellery manufacturers, especially since the cases or boxes are retained throughout the lifetime of the object. It is therefore necessary to observe a traditional mode of presentation and to propose a simple, refined packaging, worthy of the object it contains.

Double packaging provides a good solution to the problem of protection, with the object contained within a first box which is in turn confined within a second box. The object is properly protected, but double packaging is expensive, and the user does not have immediate access to the object.

Cases with hinged covers are also quite expensive solutions.

Cardboard type packaging exists which answers the requirement for protection with the choice of a sufficiently thick material. Cardboard packaging also has the advantage of being affordable, and can accommodate any type of decoration. Pre-assembled cardboard boxes take up storage space. The advantage of foldable cardboard packaging is flat storage, which saves space, combined with a lower cost than that of pre-assembled cardboard packaging, because no assembly labour is required. However, it is often difficult to keep the packaging in a deployed position, unless flaps or tabs are used, which are unattractive and deteriorate over time after a certain number of manipulations, or without accepting a reduction in the internal volume available for housing the folds or double walls, or similar, required by folding and unfolding kinematics.

French Patent Application No 2678583 in the name of EDITH HERMAN describes a display case packaging formed from a single blank with a system of folding around a square base. However, this simple case includes gussets occupying part of the internal volume, EP Patent Application No 1228971 in the name of KRAFFT GOEBEL presents a shock resistant case wherein the product to be protected is held by Z-shaped wing flaps exhibiting a certain elasticity.

EP Patent No 0489606B1 in the name of HRICOVINI EVA describes a family of cardboard boxes closed by partially open tetrahedrons which are folded down over the opening for the insertion of the contents.

FR Patent Application No 2665881A1 in the name of RICHEZ NICOLE describes a folding packaging cooperating with a folding display case in the form of two independent parts, which is the usual configuration for a jewellery box or case. U.S. Pat. No. 5,873,457A in the name of MADWED MARK discloses the holding of an object of toroid shape, such as a watch, around a cross member inserted into two opposite openings in a case with a hinged cover forming a box, said cross member being operated like a drawer to either secure or release the watch from its box, as required.

US Patent No 20060191801 in the name of JACK HERZOG discloses, in a similar manner, a case with a hinged cover, including a hollow compartment for receiving a watch, wherein the watch may or may not be secured to the case by a through elastic pin.

Known foldable boxes all have the same tendency to collapse into themselves, and cannot maintain a right angled geometry without the presence of a false bottom or cushioning element.

In short, there exist few low cost boxes, which can be stored flat and are capable of offering good protection to a timepiece or similar, while having an elegant attractive appearance with no projecting or fragile elements.

EP Patent Application No 2602205 in the name of TISSOT SA proposes a foldable, flat-storable box with two pre-assembled prismatic structures which can be folded one on the other for construction of the deployed box, which are held rigidly in position by intrinsic struts and/or by a movable cross member.

SUMMARY OF THE INVENTION

The invention proposes to overcome the drawbacks of known technologies and ensure that quality is maintained in a more economical packaging which includes the fewest possible components. More specifically, the invention is devised for holding precious objects of substantially toroid shape, and is very versatile, easy to assemble and suitable for high quality packaging for all types of objects.

Thus, the invention concerns a folding box or case for the packaging of at least one object or a piece of jewellery or timepiece, said folding box being flat-storable in a base plane defined by a longitudinal direction and by a transverse direction, said box including a foldable inner container formed by a first band closed on itself and forming a first deformable prism unfoldable between a flat position and a deployed position where said first deformable prism is open at two opposite ends in a direction parallel to said transverse direction, said inner container including a handling surface which is secured to a second band extending in said transverse direction, and said second band being secured, on a base separate from said inner container, to an outer envelope formed by a third band extending in said longitudinal direction and deformable between a flat storage position in said plane and a folded position where said third band is closed on itself and arranged to surround said inner container, said inner container is foldable along a fold comprised in said second band between said handling surface and said base, when said inner container is in a deployed position and is in a folded over position, supported on an upper surface of said base so that one of said outer openings of said inner container is closed by said base, characterized in that said upper surface of said base includes at least one projecting indexing element arranged to hold said inner container in a single particular position of deployment of said first prism on said base when said inner container is in said position folded over onto said base.

According to a feature of the invention, said second band is extended, in said transverse direction, by a fourth band adjacent to said handling surface or to said main base and which extends in said transverse direction, and which is deformable between a flat storage position in said plane and a wound or folded position in which said fourth band is wound or folded inside said inner container when said inner container is in said single particular position of deployment, and said inner container includes, on at least one inner surface of said prism, support means arranged to form at least one end support surface for said fourth band.

According to a feature of the invention, said support means include at least one U-shaped or L-shaped support on an inner surface of said inner container, and in that said fourth band includes a series of parallel folds delimiting band portions, each of adjusted length arranged to abut on a corresponding segment of said U-shaped or L-shaped support, said parallel folds corresponding to the edges of said U-shaped or L-shaped support.

According to a feature of the invention, said fourth band includes, at the distal end thereof furthest from the area of attachment to said handling surface or respectively said main base, a fifth band closed on itself and forming a fifth deformable prism unfoldable between a flat position and a deployed position where said fifth deformable prism is open at both opposite ends in a parallel direction to said longitudinal direction, said fifth prism being arranged to cooperate in abutment, in said deployed position thereof, with a bearing surface of said at least one support, and with an inner surface of said first prism of said inner container.

According to a feature of the invention, said fifth deformable prism forms, in said deployed position thereof mounted supported on said at least one support and on said inner surface of said prism of said inner container, a rigidifying structure for said inner container in said single particular position of deployment of said first prism, and prevents deformation of said inner container.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1A:
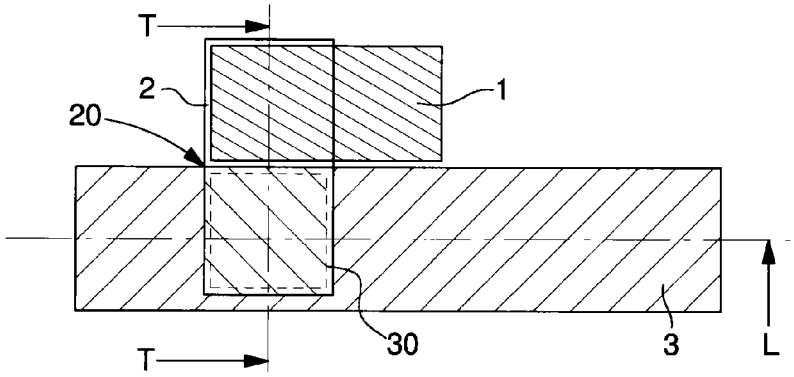
FIGS. 1A, 1B and 1C each show schematic plan views of a box according to the invention, including a plurality of bands superposed on each other and all secured to each other, FIG. 1A illustrating the simplest version, FIG. 1B an improved version, and FIG. 1C an improved and reinforced version.

The invention is an improvement of the invention forming the subject of Patent Application Nos CH705963, EP2602205A1, and WO2013083420A1, whose content is incorporated herein by reference.

The invention concerns the field of the packaging of objects, and more specifically the field of boxes, particularly for the field of horology or jewellery. It also concerns packaging for the transport or storage of objects, particularly for timepieces or pieces of jewellery.

"Box" is used hereinafter to mean any packaging intended for the sale, handling or storage of these objects.

The invention more particularly concerns objects 200, particularly pieces of jewellery or timepieces. These objects 200 may be of various geometries, and may be fixed to a support, or inside an enclosed space, or, in a particular application of the invention, "toroid" shaped, i.e. objects that form, in the closed state for those having a variable geometry, a ring or a torus, and which can be fitted around a support or closed around a support. More specifically, and in a non-limiting manner, the invention is applicable to objects 200 which are wristwatches, or bracelets, or rings. These objects are generally referred to hereinafter as "object 200".

The invention is more precisely described here, in a non-limiting manner, in a thick cardboard embodiment, with creases for the folds and decorated. This embodiment is both economical, solid and attractive. The invention can also be made using other materials, such as leather or imitation leather, thin wood, coated textile, sheet metal, or a metal sandwich compound formed of aluminium sheets or similar material.

Thus, the invention concerns a folding box 100 for packaging at least one object 200 or a piece of jewellery or timepiece.

This folding box 100 is flat storable in a base plane P defined by a longitudinal direction L and by a transverse direction T.

Box 100 includes a folding inner container 1, which is formed by a first band closed on itself and forming a first deformable prism unfoldable between a flat position and a deployed position where the first deformable prism is open at both opposite ends in a direction parallel to transverse direction T.

This inner container 1 includes a handling surface 10 which is secured to a second band 2 extending in transverse direction T.

Second band 2 is secured, on a main base 30 separate from inner container 1, to an outer envelope 3. This outer envelope 3 is formed by a third band extending in longitudinal direction L, and which is deformable between a flat storage position in plane P and a folded position where the third band is closed on itself and arranged to surround inner container 1.

Second band 2 includes a fold 20 (or a hinged surface) between handling surface 10 and main base 30. Inner container 1 can be folded along this fold 20, when inner container 1 is in a deployed position and is in a folded down position, supported on one of the upper surfaces 30S of main base 30, so that one of the outer openings of inner container 1 is closed by main base 30.

According to the invention, the upper surface 30S of main base 30 includes at least one projecting indexing element 28, 29, arranged to hold inner container 1 in a single particular deployed position of the first prism on main base 30, when inner container 1 is in the position folded over onto main base 30.

Figure 1B:
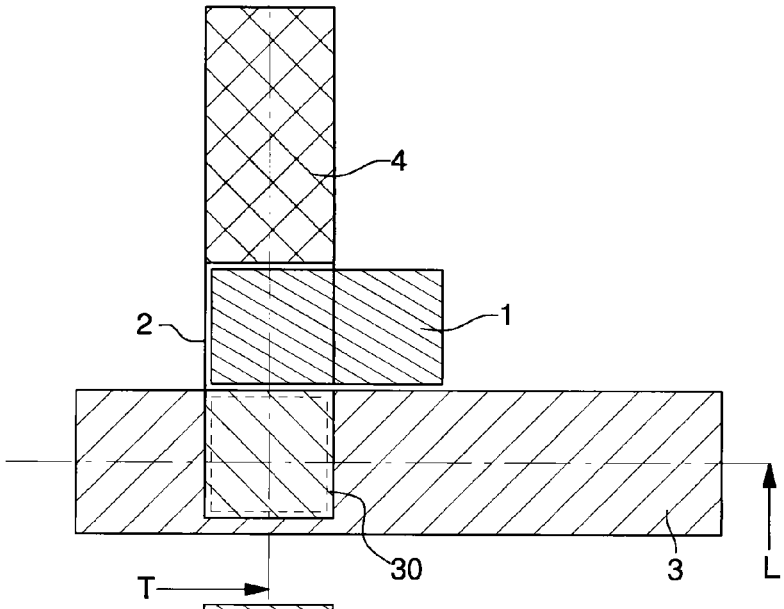

FIGS. 1, 1A and 1B each show a variant of this box 100, including a plurality of bands superposed on each other and all secured to each other.

FIG. 1A is a basic illustration of the simplest version where the box includes only inner container 1, second transverse band 2 and third longitudinal band 3.

FIG. 1B illustrates an improved version of folding box 100 where second band 2 is extended, in transverse direction T, by a fourth band 4 adjacent to handling surface 10 in the illustrated version, or adjacent to main base 30 in a variant that is not shown where inner container 1 and fourth band 4 are on either side of base 30.

This fourth band 4 extends in transverse direction T, and is deformable between a flat storage position in plane P and a wound or folded position in which fourth band 4 is wound or folded inside inner container 1 when inner container 1 is in the single particular deployed position.

Inner container 1 advantageously includes, on at least one inner surface of the first prism, support means 8 which are arranged to form at one abutment surface for fourth band 4.

In a specific, non-limiting embodiment, these support means 8 include at least one U-shaped (FIG. 6A) or L-shaped (FIG. 6) support 43, 44 on an inner surface of inner container 1. Preferably, support means 8 include two supports 43, 44, disposed in symmetrical pairs on opposite inner faces of inner container 1.

Fourth band 4 includes a series of parallel folds 11, 13 delimiting band portions 10A, 12, 14, each of adjusted length arranged to abut on a corresponding segment of the U-shaped or L-shaped support, the parallel folds corresponding to the edges of the U-shaped or L-shaped support.

Figure 6A:
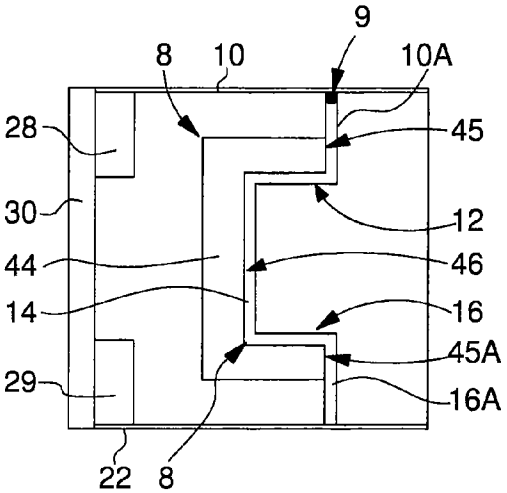
FIG. 6A shows, in a similar manner to FIG. 6, a variant with a box in the arrangement of FIG. 1B, with folding of the fourth band to fit a U-shaped lateral support.

FIG. 6A thus shows a U-shaped support 44, where the fourth band is fixed in a segment 9 on handling surface 10 of inner container 1; one portion 10A abuts, parallel to base 30, on one face 45 of support 44, one fold 11 faces one edge of support 44, one portion 12 abuts on one face of support 44 perpendicular to base 30 as far as fold 13, after which one portion 14 abuts on one face 46 of support 44 parallel to base 30. One portion 16 and one portion 16A abut in a symmetrical manner on the other faces of support 44. Fourth band 4 thus forms a continuous surface, with a U-shaped profile which is extended on either side of the U by two wings extending substantially parallel to surface 14 forming the base of the U-shaped profile parallel to main base 30. This continuous surface forms a container for receiving an object 200.

Figure 1C:
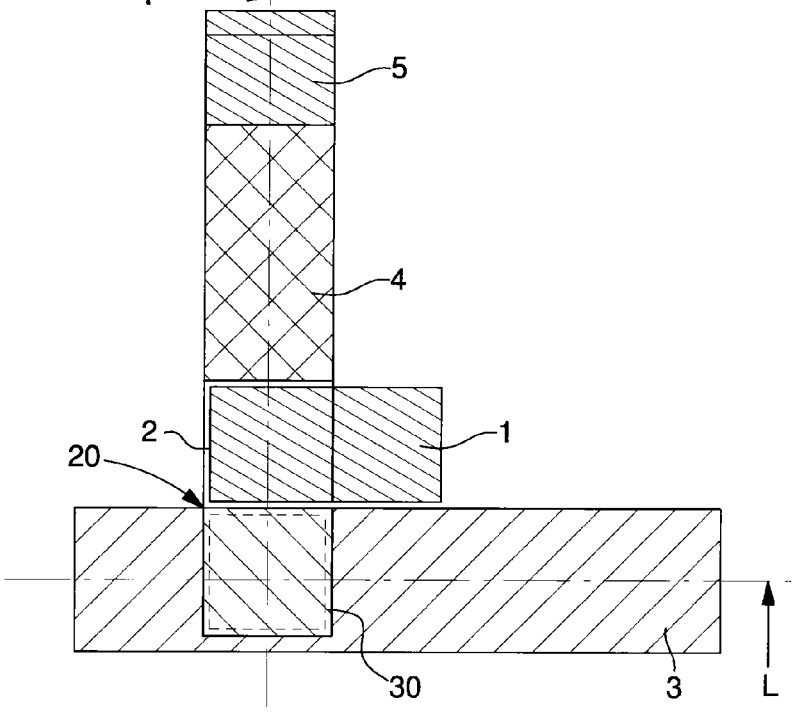

FIG. 1C illustrates an improved and reinforced version of folding box 100, wherein the fourth band 4 includes, at the distal end thereof furthest from the area of attachment to handling surface 10 (or respectively main base 30 as above), a fifth band 5 closed on itself and forming a fifth deformable prism unfoldable between a flat position and a deployed position where the fifth deformable prism is open at two opposite ends in a direction parallel to longitudinal direction L.

This fifth prism is arranged to cooperate in abutment, in its deployed position, with a bearing surface 46 of at least one support 43, 44 and with an inner surface of the first prism of inner container 1.

Figure 6:
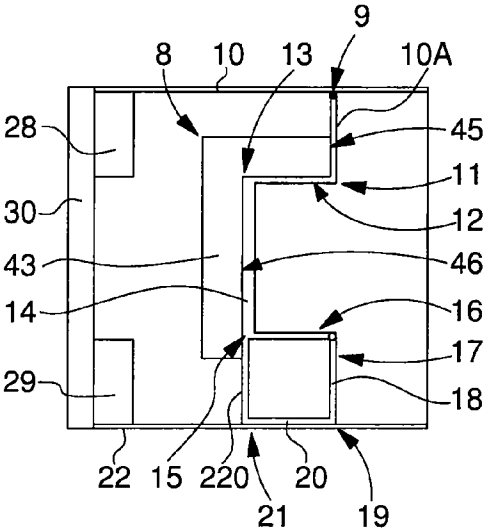
FIG. 6 shows a section of the box of FIG. 3 along a mid-plane of both the inner container and the fourth and fifth bands, showing said bands in the end position folded over and locked inside the inner container, resting on the L-shaped supports therein.

FIG. 6 thus shows an L-shaped support 43, where the fourth band is fixed in a segment 9 on handling surface 10 of inner container 1; one portion 10A abuts, parallel to base 30, on one face 45 of support 44, one fold 11 faces one edge of support 43, one portion 12 abuts on one face of support 43 perpendicular to base 30 as far as fold 13, after which one portion 14 abuts on one face 46 of support 43 parallel to base 30.

A double fold forming seam 15 connects portion 14 to the fifth prism. One portion 16 is symmetrical to portion 12 connected by a fold 17 to a portion 18 parallel to base 30, connected by a fold 19 to a portion 20 which abuts on one of the inner surfaces of one face 22 of inner container 1, and which is connected by a fold 21 to a last portion 220 which abuts on surface 46 and rejoins fold seam 15. The fourth band 4 and the fifth band thus form together a continuous surface with a U-shaped profile which is extended on either side of the U by two wings extending substantially parallel to surface 14 forming the base of this U-shaped profile parallel to main base 30. This continuous surface forms a container for receiving an object 200.

The fifth deformable prism forms, in said deployed position thereof mounted supported on at least one support 43, 44 and on the inner surface of the first prism of inner container 1, a rigidifying structure for inner container 1 in the single particular deployed position of the first prism, and prevents any deformation of inner container 1.

FIGS. 2, 4, 6, 6A also show projecting indexing elements 28, 29 of prismatic shape, each for cooperating with three of faces 10, 21, 22, 23 8 (connected to each other by folds 24, 25, 26, 27) of inner container 1 when the latter is of rectangular or square section. Other prism profiles can be used for container 1, or for third band 3, without departing from the scope of the invention.

Figures 2, 3:
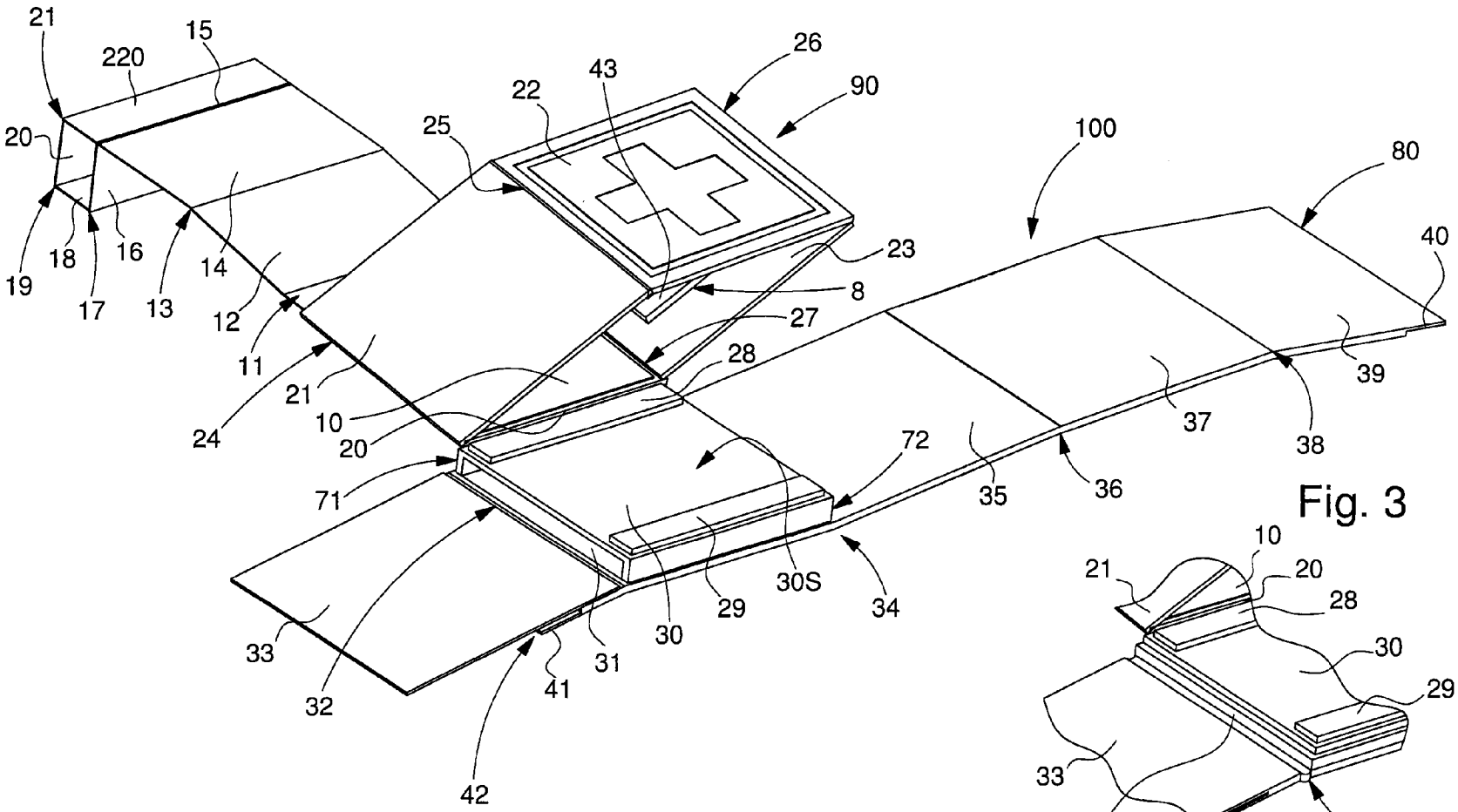
FIG. 2 shows a schematic perspective view of the box of FIG. 1C including an inner container (shown with a Swiss Cross) in the form of a first band closed on itself and forming a first deformable prism, shown here in an intermediate deployed position, and in an intermediate position folded over onto a base common both to a second transverse band carrying on of the sides of the inner container, and to a third longitudinal band intended to envelop the inner container after is is completely deployed and folded over; the second band is extended by a fourth band intended to be inserted in the inner container to form a cradle for receiving an object, in cooperation with a fifth band forming a fifth deformable prism, shown in an intermediate deployed position; here the common base carries two projecting indexing elements arranged to hold the inner container in a single particular position of deployment on the main base when the inner container is in the position thereof folded over onto the main base. These projecting indexing elements here form stops immobilising the sides of the inner container. The main base is secured to a second base integrated in the third longitudinal band, and between them is arranged a space for insertion of documents, or suchlike.
FIG. 3 is a detail of a simplified variant of FIG. 2, where the main base bears directly on the third longitudinal band.
Figure 4:
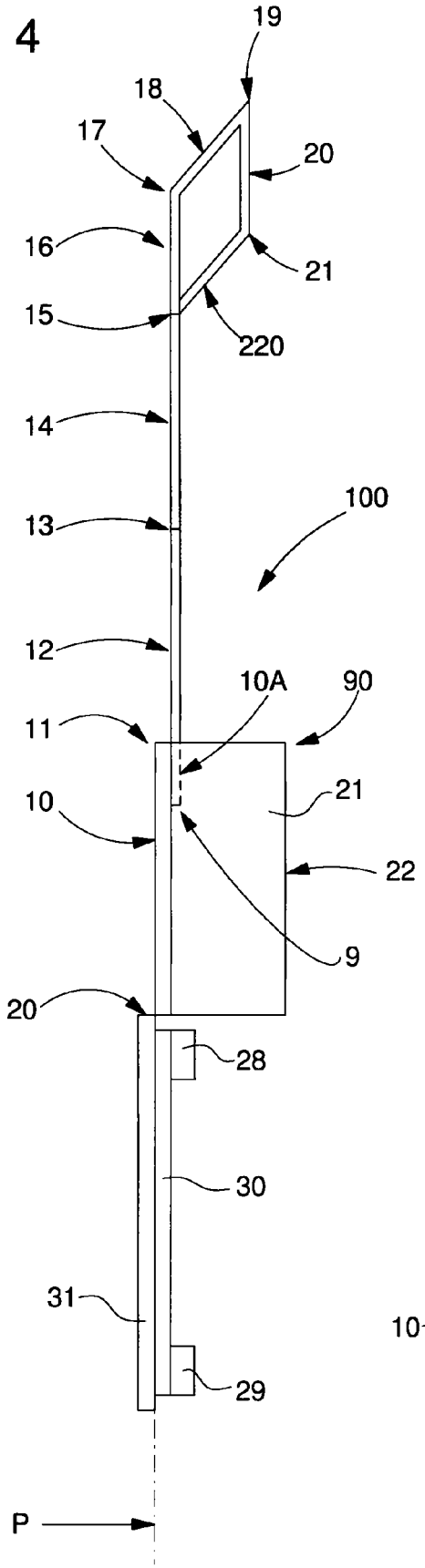
FIG. 4 is a side view (from the left side) of the box of FIG. 3.
Figure 4A:
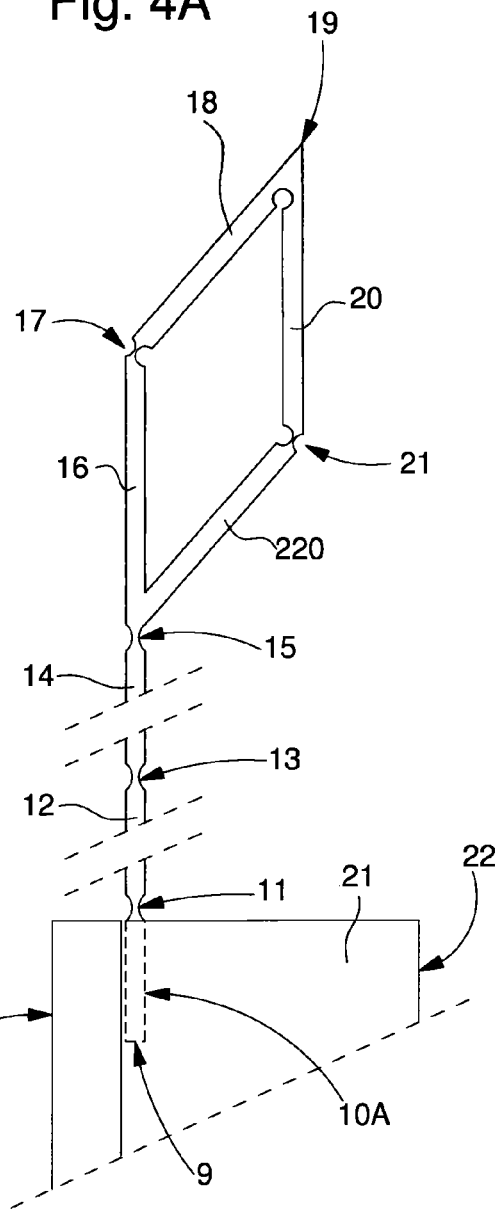
FIG. 4A is an enlarged detail.
Figures 5, 5A:
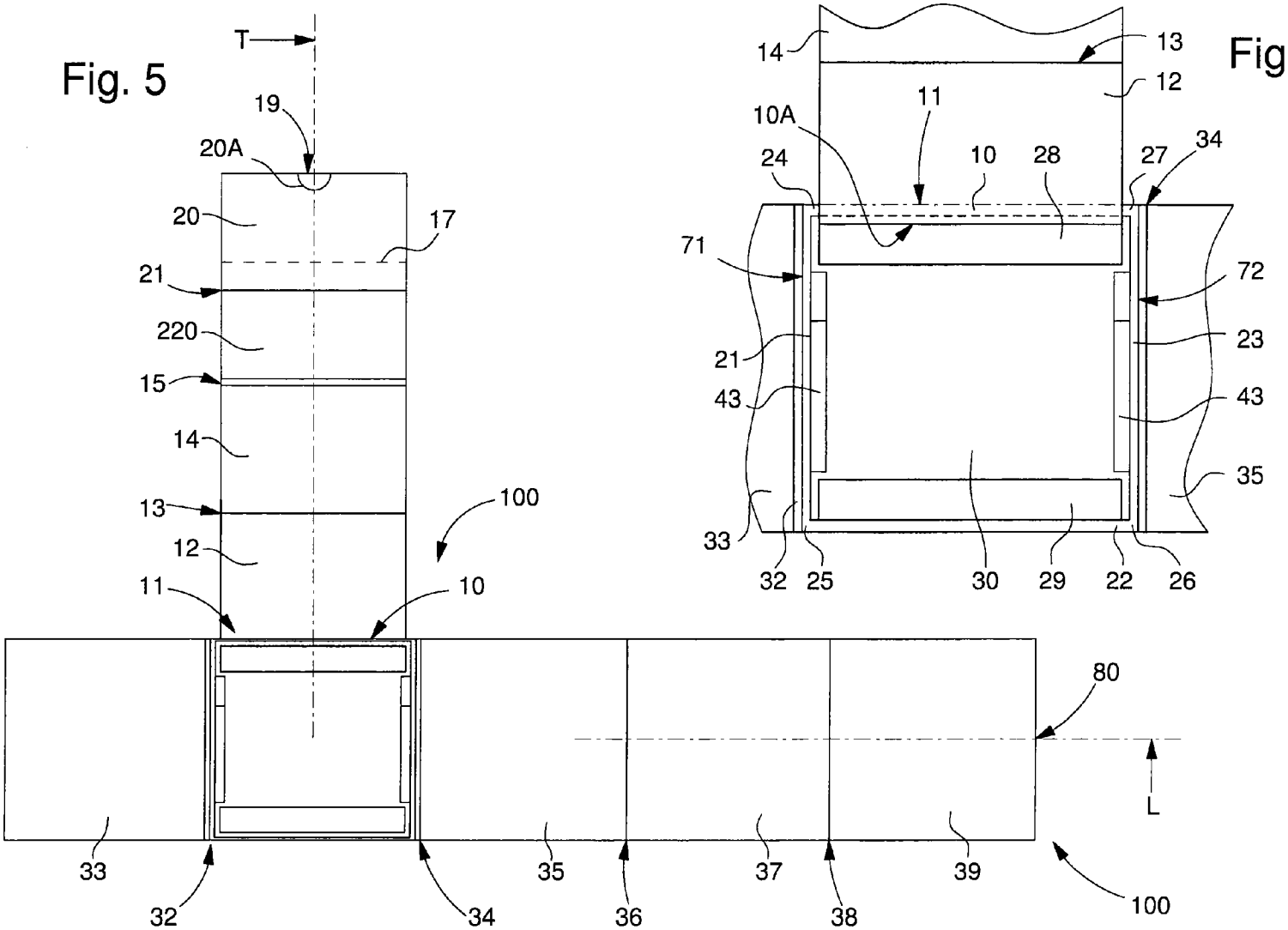
FIG. 5 is a top plan view of the box of FIG. 2 or 3 in a position where the inner container is completely deployed in its single particular deployed position, and folded over onto the main base, in a position indexed by the two projecting indexing elements.
FIG. 5A is a detail of the cooperation between the inner container, the base, and the start of the fourth band.
Figure 7:
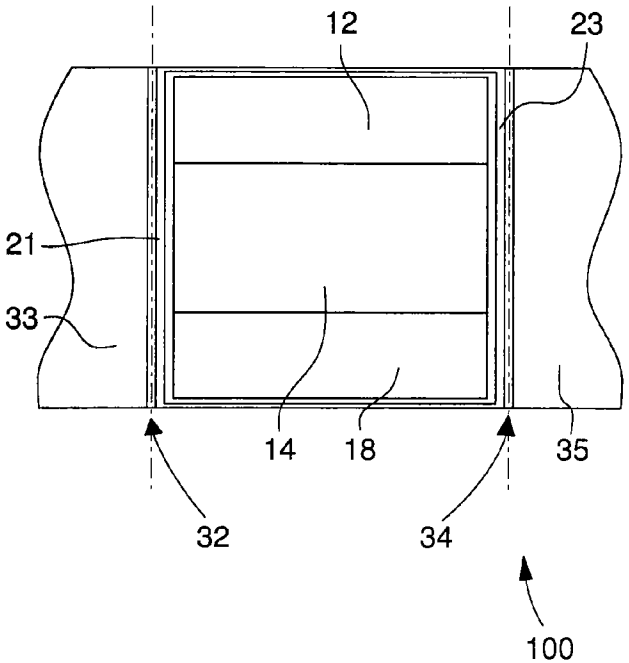
FIG. 7 is a detailed top view of the box of FIG. 6.

The edges 71 and 72 of the rigid structure formed, in FIG. 2, by base 30, face 31 of the third band, and the side bands which join base 30 and face 31, also provide an additional rigidifying element for folding box 100 in its operative position.

In the specific variants of FIG. 2 or 3, all the prisms are of rectangular, particularly square, cross-section.

Advantageously, fifth band 5 includes at least one notch 20A of similar, for facilitating an insertion or unfolding operation, and which is arranged to be gripped by a user's finger, or by a tool, or for housing an actuating cord or strip, or similar.

Figure 8A:
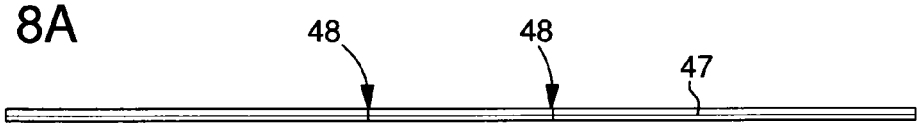
FIGS. 8A, 8B, 8C show a removable component of the box according to the invention, formed by a bistable shape memory band deformable between a first flat position, shown in a side view in FIG. 8A and in a top view in FIG. 8B, and at least one deformed loop-shaped position shown in a side view in FIG. 8C.
Figure 8B:
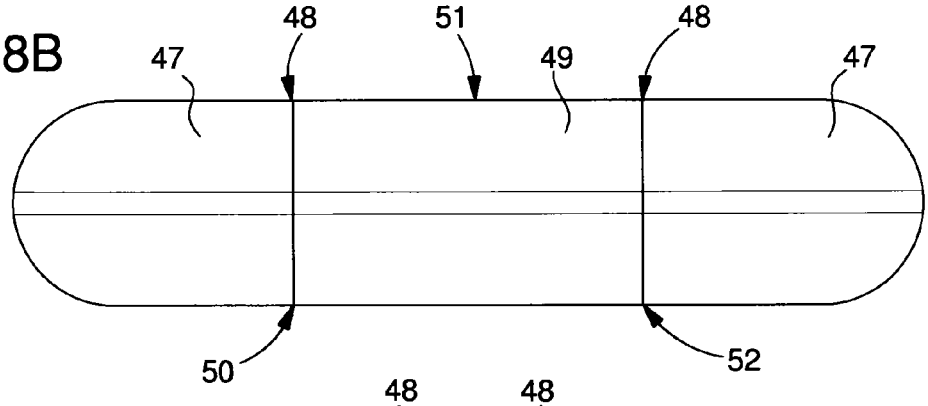
Figure 8C:
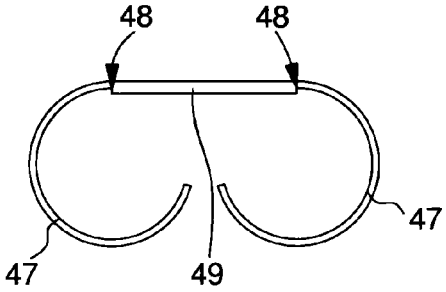
Figure 9:
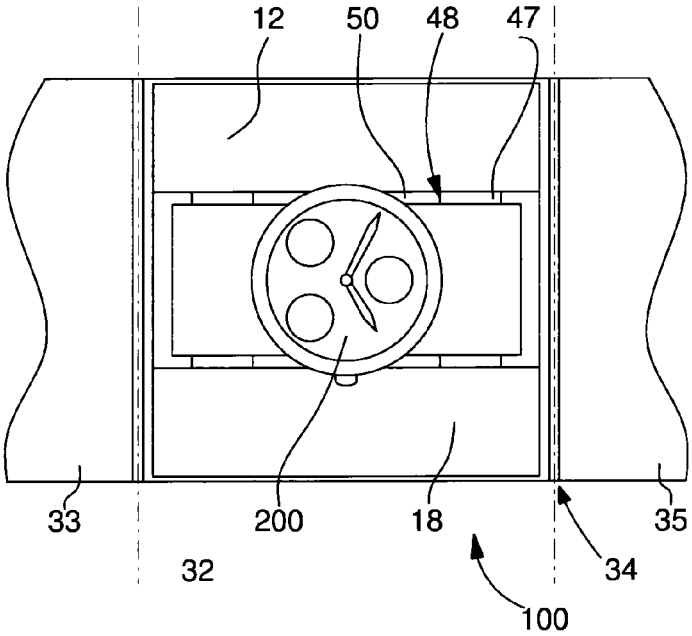
FIG. 9 shows, in a similar manner to FIG. 7, a watch fixed to the removable element in the position of FIG. 8C; said removable element is inserted without play into the central housing visible in FIGS. 6 and 7.
Figure 10:
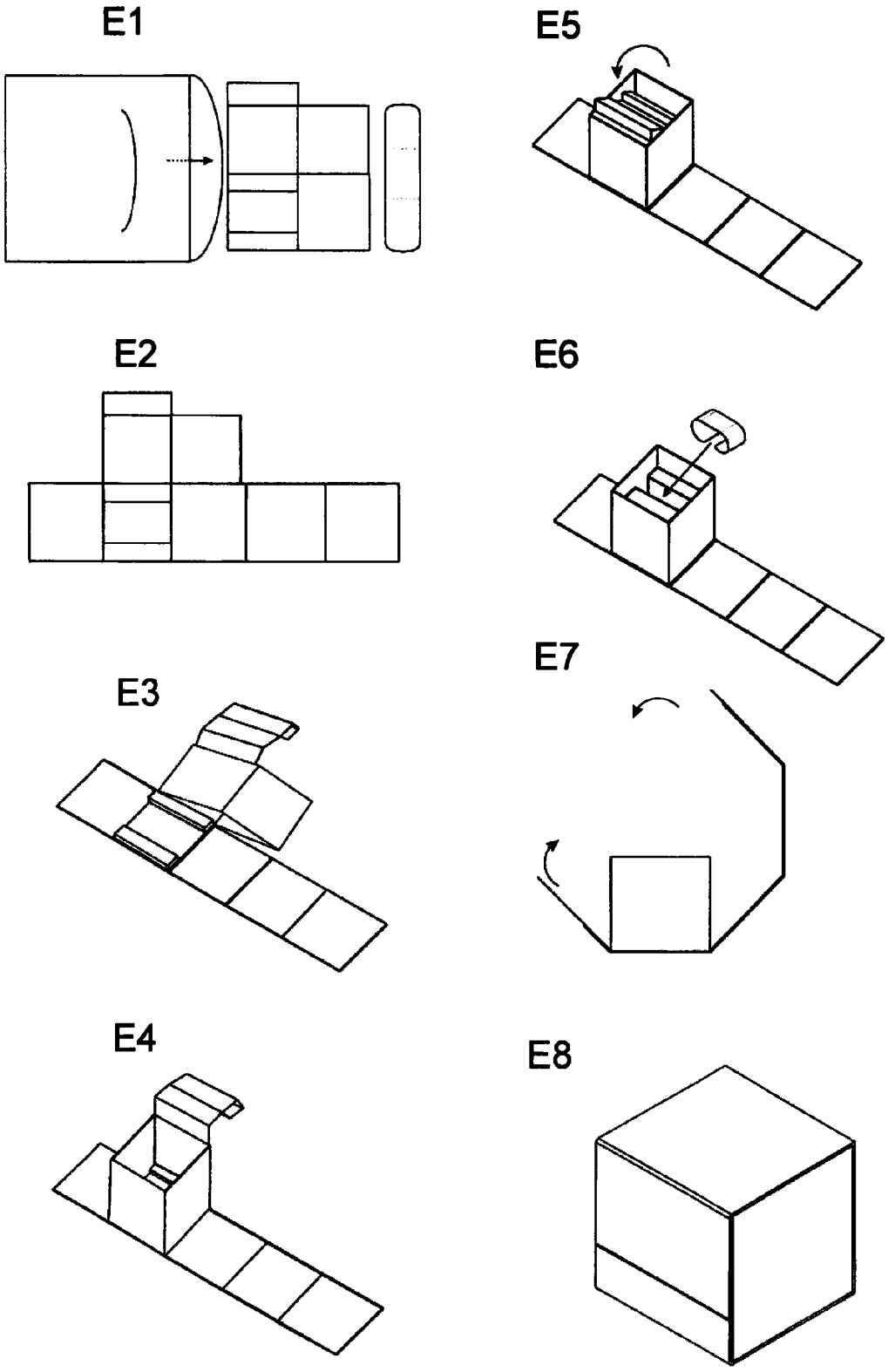
FIG. 10 illustrates in eight steps, from E1 to E8, the assembly of the box according to the invention, from the removal thereof, flat, from a flat envelope that also contains the removable component of FIGS. 8A, 8B, 8C also in a flat state, to the final assembly of the box in the mounted and folded service position

Advantageously, folding box 100 includes a removable component, which is also flat storable, formed by a bistable shape memory band 50 deformable between a first flat position seen in FIGS. 8A and 8B, and at least one deformed loop-shaped position visible in FIG. 8C, where two ends 48 are bent, at connecting edges 48, around a central portion 49.

This bistable band 50 includes two lateral surfaces 51, 52, which are arranged to cooperate to fit with two parallel surfaces of the U-shaped continuous surface corresponding to the parallel branches of the U, and the dimensions of the loop are suitable for assembly of an object 200 around the loop. It is easy to make bistable bands with the same total width, but of variable shapes and lengths as regards central portions 49 and ends 47 so as to allow optimum packaging for varied collections of objects 200, for example men's/ladies'/children's watches, bracelets, rings, or suchlike.

In the variant of folding box 100 in FIGS. 2 and 3, the first prism forms the framework of a rectangular parallelepiped whose base is formed by main base 30 and whose lid is formed by a flap 37 comprised in outer envelope 3.

In a variant, the outer envelope 3 includes, at both ends thereof in longitudinal direction L, two closing flaps 33, 39 which are arranged to be superposed on each other, when outer envelope 3 is in the single particular deployed position of the first prism. Closing flaps 33 and 39 include mutually complementary locking means 40 and 42 for holding packaging band 3 in position wound around inner container 1.

More specifically, these locking means 40, 42 are held together by the thickness of the material forming closing flaps 33, 39 and include, on the one hand, a mortise type member 42 or cut-out portion, and on the other hand, a tenon type member 40 of complementary profile to that of mortise member 42.

In the version illustrated by FIG. 2, flap 39, which forms one end of the third band, carries a tab 40 which is insertable in a slot 42 formed in the thickness of flap 33 forming the other end of the third band, under a cover 41 secured to flap 33.

In a variant that can be combined with the preceding variant, locking means 40, 42 include at least one pole shoe arranged to work in attraction with a complementary pole shoe, at least one of the pole shoe and complementary pole shoe being formed by a magnet.

In the embodiment of FIG. 2, main base 30 is secured to a second base 31 integrated in the third longitudinal band, and between them is arranged a space for insertion of documents, or suchlike. In the variant of FIG. 3, base 30 abuts directly on a face 31 of the third band. Base 30 and face 31 may also be merged.

The third band includes a series of faces 33, 31, 35, 37, 39 respectively alternating with folds 32, 34, 36 and 38.

Advantageously, inner container 1 and the components secured thereto are made of cardboard that can be folded and/or rolled, comprising corrugated folds. This embodiment is very solid, very economical and easily lends itself to the affixing of any decoration.

Naturally, outer envelope 3 and inner container 1 may be made of different materials, which allows for a large variety of models.

What is claimed is:

1. A folding box or case for the packaging of at least one object or a piece of jewellery or timepiece, said folding box being flat-storable in a base plane defined by a longitudinal direction and by a transverse direction, said box including a foldable inner container formed by a first band closed on itself and forming a first deformable prism unfoldable between a flat position and a deployed position where said first deformable prism is open at two opposite ends in a direction parallel to said transverse direction, said inner container including a handling surface which is secured to a second band extending in said transverse direction, and said second band being secured, on a main base separate from said inner container, to an outer envelope formed by a third band extending in said longitudinal direction and deformable between a flat storage position in said plane and a folded position where said third band is closed on itself and arranged to surround said inner container, said inner container is foldable along a fold comprised in said second band between said handling surface and said main base, when said inner container is in a deployed position and is in a folded over position, supported on an upper surface of said main base so that one of said two opposite open ends of said inner container is closed by said main base, wherein said upper surface of said main base includes at least one projecting indexing element arranged to hold said inner container in a single particular position of deployment of said first prism on said main base when said inner container is in said position folded over onto said main base.

2. The folding box according to claim 1, wherein said second band is extended, in said transverse direction, by a fourth band adjacent to said handling surface or to said main base and which extends in said transverse direction, and which is deformable between a flat storage position in said plane and a wound or folded position in which said fourth band is wound or folded inside said inner container when said inner container is in said single particular position of deployment, and further wherein said inner container includes, on at least one inner surface of said prism, support means arranged to form at least one abutment surface for said fourth band.

3. The folding box according to claim 2, wherein said support means include at least one U-shaped or L-shaped support on an inner surface of said inner container, and wherein said fourth band includes a series of parallel folds delimiting band portions, each of adjusted length arranged to abut on a corresponding segment of said U-shaped or L-shaped support, said parallel folds corresponding to the edges of said U-shaped or L-shaped support.

4. The folding box according to claim 3, wherein said fourth band includes, at the distal end thereof furthest from the area of attachment to said handling surface or respectively said main base, a fifth band closed on itself and forming a fifth deformable prism unfoldable between a flat position and a deployed position where said fifth deformable prism is open at both opposite ends in a parallel direction to said longitudinal direction, said fifth prism being arranged to cooperate in abutment, in said deployed position thereof, with a bearing surface of said at least one support, and with an inner surface of said first prism of said inner container.

5. The folding box according to claim 4, wherein said fifth deformable prism forms, in said deployed position thereof mounted supported on said at least one support and on said inner surface of said prism of said inner container, a rigidifying structure for said inner container in said single particular position of deployment of said first prism, and prevents any deformation of said inner container.

6. The folding box according to 3, wherein said support means include two symmetrical supports on two opposite inner surfaces of said inner container.

7. The folding box according to claim 3, wherein said fourth band is arranged to form, in abutment on said at least one support and on said inner surface of said first prism of said inner container, a continuous surface, with a U-shaped profile which is extended on both sides of said U by two wings extending substantially parallel to the surface forming the base of said U-shaped profile which is parallel to said main base, said continuous surface forming a container for receiving said object.

8. The folding box according to claim 7, wherein said folding box includes a removable component formed by a bistable shape memory band deformable between a first flat position and at least one deformed loop-shaped position, and including two lateral surfaces arranged to cooperate to fit with two parallel surfaces of said continuous surface with a U-shaped profile and corresponding to the parallel branches of said U, and the dimensions of said loop being suitable for assembly of a said object around said loop.

9. The folding box according to claim 1, wherein said first prism forms the framework of a rectangular parallelepiped whose base is formed by said main base and whose cover is formed by a flap comprised in said outer envelope.

10. The folding box according to claim 1, wherein said outer envelope includes, at both ends thereof in said longitudinal direction, two closing flaps arranged to move into superposition on each other when said outer envelope is in said single particular deployed position of said first prism, sad closing flaps including mutually complementary locking means to ensure said packaging band forming said outer envelope is held in position wound around said inner container.

11. The folding box according to claim 10, wherein said mutually complementary locking means are held together by the thickness of the material forming said closing flaps, and include, on the one hand, a mortise type member or cut-out portion, and on the other hand, a tenon type member of complementary profile to that of said mortise.

12. The folding box according to claim 10, wherein said mutually complementary locking means include at least one pole shoe arranged to work in attraction with a complementary pole shoe, at least one of said pole shoe and said complementary pole shoe being formed by a magnet.

13. The folding box according to claim 1, wherein said inner container and the components secured thereto are made of cardboard, and wherein said folds are corrugated.

* * * * *